US006877845B2

(12) United States Patent
Nakashima

(10) Patent No.: US 6,877,845 B2
(45) Date of Patent: Apr. 12, 2005

(54) INK-JET HEAD AND METHOD FOR PRODUCING THE SAME

(75) Inventor: Hiroaki Nakashima, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 68 days.

(21) Appl. No.: 10/346,845

(22) Filed: Jan. 17, 2003

(65) Prior Publication Data

US 2003/0137564 A1 Jul. 24, 2003

(30) Foreign Application Priority Data

Jan. 22, 2002 (JP) ..... 2002-012266

(51) Int. Cl.[7] ..... B41J 2/045
(52) U.S. Cl. ..... 347/72
(58) Field of Search ..... 347/68–72, 47; 156/291, 290, 60

(56) References Cited

U.S. PATENT DOCUMENTS 4,994,825 A * 2/1991 Saito et al. ..... 347/63
5,439,728 A * 8/1995 Morozumi et al. ..... 428/136
6,168,255 B1 * 1/2001 Nagashima ..... 347/20

FOREIGN PATENT DOCUMENTS

JP 05330067 A 12/1993
JP 2000-117974 A 4/2000
JP 2001063052 A 3/2001

* cited by examiner

*Primary Examiner*—Michael S. Brooke
(74) *Attorney, Agent, or Firm*—Harness, Dickey & Pierce, P.L.C.

(57) ABSTRACT

The ink-jet head includes: a nozzle plate having a plurality of nozzles; a head body including a plurality of pressure chambers for storing ink, the pressure chambers communicating with the respective nozzles, and a plurality of actuators for applying pressure to the ink in the pressure chambers to allow the ink to be discharged from the nozzles; and a bonding layer made of an adhesive formed between the nozzle plate and the head body for bonding the nozzle plate and the head body together. A passage extending from an inner region to an outer region is formed in the bonding layer.

8 Claims, 8 Drawing Sheets

INK-JET HEAD AND METHOD FOR PRODUCING THE SAME

BACKGROUND OF THE INVENTION

The present invention relates to an ink-jet head and a method for producing an ink-jet head.

Conventionally, as an ink-jet head, one produced by bonding a nozzle plate defining a plurality of nozzles to a head body is known. The head body of this type of ink-jet head includes a plurality of pressure chambers storing ink, ink channels communicating with the pressure chambers, and actuators for applying pressure to the ink in the pressure chambers. The nozzle plate is bonded to the head body so that the respective nozzles communicate with the corresponding ink channels. With application of pressure to the ink in the pressure chambers, part of the ink in the pressure chambers flows through the ink channels and is discharged out from the nozzles as ink droplets.

An adhesive is often used for the bonding between the nozzle plate and the head body. During this bonding, various problems arise due to the smallness of the sizes of the nozzle plate and the head body. That is, if an excessive amount of an adhesive is applied, the adhesive may protrude into the ink channels, blocking smooth flow of ink, and this may cause discharge failure. In addition, if an air bubble is mixed in the adhesive, the air-trapped bubble portion of the adhesive fails to provide sufficient adhesion, and this may cause bonding failure.

To prevent the problems described above, various techniques have been proposed. For example, Japanese Laid-Open Patent Publication No. 5-330067 discloses providing an escape groove for an adhesive in a head body, for prevention of protrusion of the adhesive into ink channels. Japanese Laid-Open Patent Publication No. 2001-63052 proposes a head body constructed of a plurality of channel plates stacked on each other, in which a through hole for escape of the air is formed in the direction of the stacking of the channel plates.

In the conventional ink-jet heads disclosed in the publications described above, the escape groove or the through hole must be provided in the head body. This complicates the structure of the head body, and thus causes reduction in yield and increase in production cost.

A thermosetting adhesive may be used as the adhesive for the ink-jet head. In this case, a by-product such as water may be generated in the process of dry setting. It is however difficult to effectively discharge such a by-product in the conventional ink-jet heads described above, in which an adhesive is solidly applied to the entire surface of the head body or the nozzle plate.

SUMMARY OF THE INVENTION

An object of the present invention is providing an ink-jet head capable of discharging bubbles and by-products smoothly without the necessity of providing an escape groove and the like in a head body and also improving the reliability of bonding of a nozzle plate.

To attain the above object, according to the present invention, an adhesive for bonding a nozzle plate and a head body together is placed in an appropriate pattern, to thereby form passages for discharging bubbles and by-products in a bonding layer formed between the nozzle plate and the head body.

The ink-jet head of the present invention includes: a nozzle plate having a plurality of nozzles; a head body including a plurality of pressure chambers for storing ink, the pressure chambers communicating with the respective nozzles, and a plurality of actuators for applying pressure to the ink in the pressure chambers to allow the ink to be discharged from the nozzles; and a bonding layer made of an adhesive formed between the nozzle plate and the head body for bonding the nozzle plate and the head body together, wherein a passage extending from an inner region to an outer region is formed in the bonding layer.

According to the ink-jet head described above, a passage is formed from the adhesive itself to extend from the inner region to the outer region in the bonding layer formed between the nozzle plate and the head body. Through this passage, bubbles and by-products generated during the bonding are discharged outside. This eliminates the necessity of providing an escape groove and the like in the head body for discharging bubbles and by-products.

Alternatively, the ink-jet head of the present invention includes: a nozzle plate having a nozzle; a channel plate having a pressure chamber for storing ink and a space constituting an ink channel communicating with the pressure chamber and the nozzle; a vibration plate for covering one side of the pressure chamber; and a piezoelectric actuator attached to a portion of the vibration plate facing the pressure chamber, for causing a mechanical displacement in the vibration plate to thereby pressurize the ink in the pressure chamber, wherein at least a pair of plates among the nozzle plate, the channel plate and the vibration plate are bonded together with an adhesive, and the adhesive is placed only in a predetermined portion of a gap between the pair of plates, leaving a portion other than the predetermined portion of the gap between the pair of plates as a space.

Preferably, the passage in the bonding layer is formed so that the cross section of the passage is greater as the position is closer to the outside.

By the above arrangement, bubbles and by-products generated during the bonding can be discharged smoothly.

The bonding layer may include a plurality of dot adhesives placed separately from one another on the nozzle plate or the head body, and the passage in the bonding layer may be formed from gaps between the dot adhesives.

By spotting a plurality of dot adhesives on the nozzle plate or the head body and bonding the nozzle plate and the head body together with the dot adhesives, gaps formed between the dot adhesives serve as a passage. In this way, the passage can be easily formed, and such passages can be formed uniformly over the nozzle plate. By this uniform placement of the adhesive, the bonding between the nozzle plate and the head body is uniform, and this increases the adhesion strength and improves the reliability of the bonding.

The total adhesive area of the dot adhesives is in a range of 30% to 70% of the area of the bonding surface of the nozzle plate.

If the adhesive area of the dot adhesives is excessively small, sufficient adhesion strength is not obtainable. If the adhesive area is excessively large, it is difficult to secure a sufficiently large cross section of the passage. In consideration of this, the total adhesive area of the dot adhesives is adjusted to be 30% to 70% of the area of the bonding surface of the nozzle plate (surface of the nozzle plate used for the bonding). By this adjustment, a passage sufficiently large for smooth discharge of bubbles and by-products can be formed while securing sufficient adhesion strength.

The dot adhesives are preferably placed on the nozzle plate or the head body so as to be sparser as the position is closer to the outside.

By the above placement, the cross section of the passage gradually increases as the position on the nozzle plate is closer to the outside, as a whole. This enables smooth discharge of bubbles and by-products toward the outside of the head.

The dot adhesives are preferably in a shape of a circle or a polygon.

The circle may be a perfect circle or an oval. The polygon may be a polygon of which one apex or two or more apexes are rounded. In short, the shape of a polygon as used herein includes a shape appearing a polygon as a whole and a shape considered substantially a polygon.

Preferably, the dot adhesives are in a shape of an oval or a polygon having apexes at both ends in the length direction, and are formed on the nozzle plate or the head body by screen printing with a squeegee by moving the squeegee in a direction equal to the direction of the length of the dot adhesives.

For the screen printing, a screen plate is used, which has small oval openings or polygonal openings having two apexes at both ends in the direction of the length of the openings. The squeegee is moved in the direction of the length of the openings. When viewed in the direction of the movement of the squeegee, the width of each opening (that is, the length in the direction orthogonal to the longitudinal direction) gradually increases and then gradually decreases. Therefore, in the application of the adhesive to the opening of the screen plate, the amount of the adhesive applied gradually increases in the beginning and gradually decreases in the end. This enables stable application of the adhesive, and thus the variation in application decreases.

The adhesive of the bonding layer is preferably applied to the nozzle plate or the head body by screen printing.

By the above application, the adhesive can be applied with good precision, and passages with a predetermined shape and size can be formed with high precision. In addition, the adhesion strength between the nozzle plate and the head body improves.

Preferably, the bonding layer includes a frame adhesive placed in a shape of a frame along the outer periphery of the nozzle plate, and the frame adhesive has an escape hole formed for permitting communication between the inner region on the nozzle plate and the outside, and the escape hole is sealed after termination of bonding between the nozzle plate and the head body.

Since the outer periphery of the nozzle plate and the head body are bonded together with the frame adhesive, the adhesion strength improves. The frame adhesive has an escape hole to allow escape of gas components such as bubbles and by-products. Therefore, in the process of bonding between the nozzle plate and the head body, bubbles and by-products passing through the passage can be discharged outside via the escape hole. After the bonding, when bubbles or by-products are no more generated, the escape hole is sealed. With this sealing, entering of ink, dust and the like from outside is prevented.

Formation of an excessively large number of escape holes will require much time and effort for sealing. Therefore, the number of escape holes is preferably in a range of 1to 10.

Preferably, a reference hole for positioning with the head body is formed on the nozzle plate, the bonding layer includes an adhesive formed around the reference hole at a position spaced from an opening edge of the reference hole, forming a non-adhesive portion between the adhesive and the reference hole.

By placing the adhesive around the reference hole at a position spaced from the opening edge, the adhesive is prevented from protruding into the opening of the reference hole. With this placement, the function of the reference hole as the reference for positioning between the head body and the nozzle plate can be secured sufficiently.

According to another aspect of the invention, an ink-jet recording apparatus is provided. The ink-jet recording apparatus includes the ink-jet head described above and a moving mechanism for providing relative movement between the ink-jet head and a recording medium.

With the above construction, an ink-jet recording apparatus including an ink-jet head highly reliable in bonding of the nozzle plate is attained.

According to yet another aspect of the invention, a method for producing an ink-jet head including a nozzle plate and a head body bonded together with an adhesive is provided. The method includes the steps of: forming a frame member along an outer periphery of a surface of at least one of the nozzle plate and the head body, the frame member having a cut portion; applying an adhesive to only a predetermined portion of a gap between the nozzle plate and the head body; bonding the nozzle plate and the head body together with the adhesive with the frame member interposed therebetween; and sealing the cut portion after a lapse of a predetermined time from termination of the step of bonding.

According to the present invention, a passage is formed in the bonding layer between the nozzle plate and the head body. Through this passage, bubbles and by-products generated in the process of bonding can be discharged outside the bonding layer. This prevents occurrence of a failure in bonding due to a bubble or a by-product remaining inside the bonding layer, and thus improves the adhesion strength and the reliability. By defining the passage with the adhesive itself, the necessity of providing an escape groove and the like in the head body is eliminated.

DESCRIPTION OF THE PREFERRED EMBODIMENTS

Hereinafter, a preferred embodiment of the present invention will be described with reference to the accompanying drawings.

Figure 1:
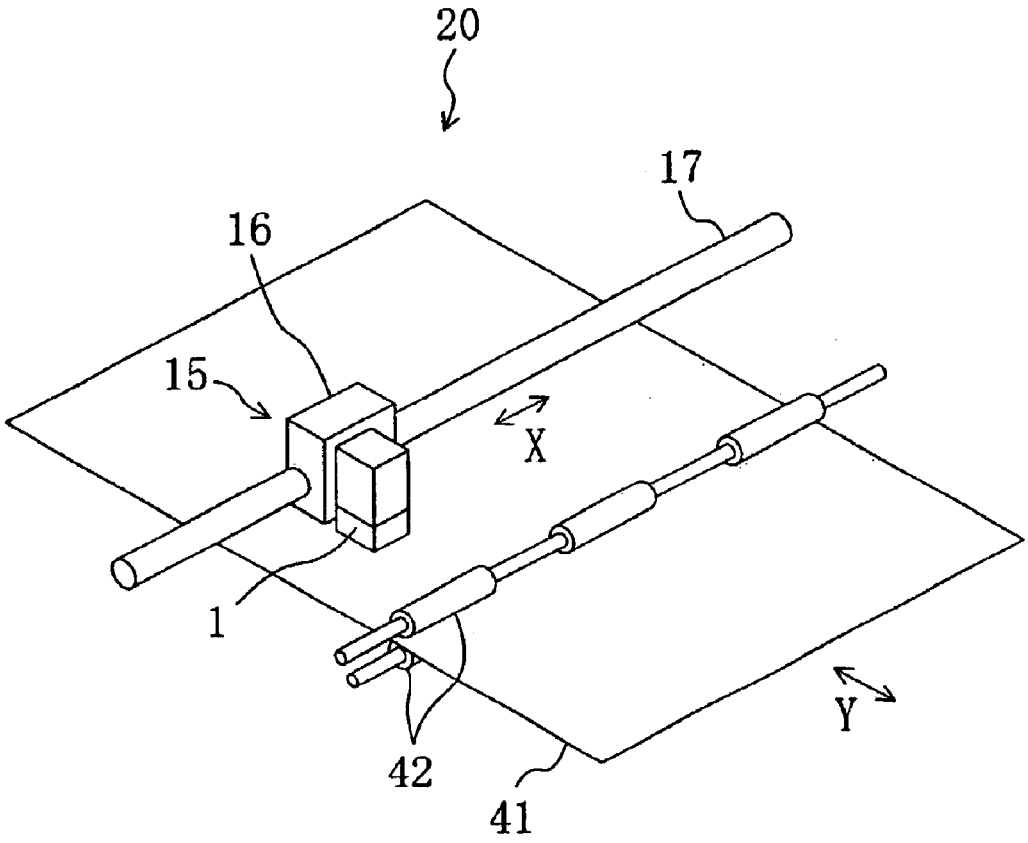
FIG. 1 is a perspective view of a main portion of a printer.

FIG. 1 illustrates a schematic construction of a printer 20 as an ink-jet recording apparatus. The printer 20 includes an ink-jet head 1 secured to a carriage 16. The carriage 16 includes a carriage motor not shown. The carriage 16, driven with the carriage motor, reciprocates in the main scanning direction (direction X in FIGS. 1 and 2) along a carriage axis 17 as a guide extending in the main scanning direction. The ink-jet head 1, secured to the carriage 16, also reciprocates in the main scanning direction X as the carriage 16 reciprocates. The carriage 16, the carriage axis 17 and the carriage motor constitute a moving mechanism 15 for providing relative movement between the ink-jet head 1 and recording paper 41.

Two transport rollers 42, pressing the recording paper 41 from the opposite sides, are rotated with a transport motor not shown. With this rotation, the recording paper 41 is transported in the sub-scanning direction (direction Y in FIG. 1) orthogonal to the main scanning direction X.

Figure 2:
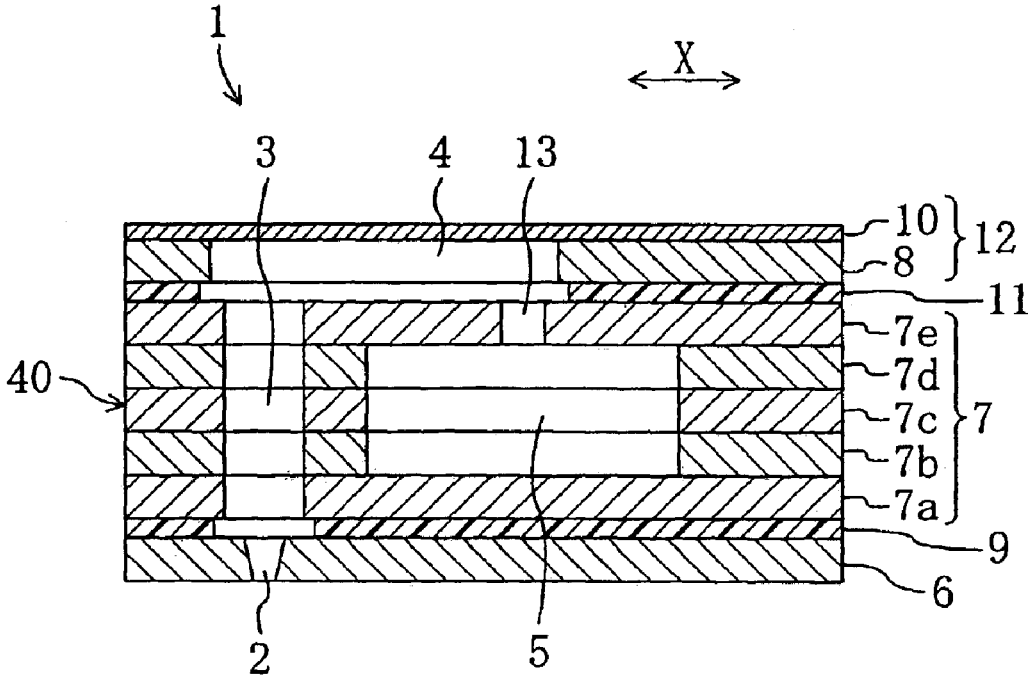
FIG. 2 is a partial cross-sectional view of an ink-jet head.

Referring to FIG. 2, the ink-jet head 1 includes a head body 40 and a nozzle plate 6 bonded to the head body 40. Note that in FIG. 2, the thickness of each layer is exaggerated appropriately for purpose of easy understanding.

The head body 40 includes a channel plate 7 and a pressure chamber member 12. The pressure chamber member 12 is composed of a defining member 8 for defining pressure chambers 4 and an actuator 10 placed on the defining member 8.

The channel plate 7 includes therein a common ink chamber 5 for storing ink, ink supply paths 13 for connecting the common ink chamber 5 and the pressure chambers 4, and discharge channels 3 for connecting the pressure chambers 4 and nozzles 2. The channel plate 7 is composed of a plurality of thin plates put one upon another. In the illustrated example, the channel plate 7 is composed of first to fifth thin plates 7*a* to 7*e*, preferably made of stainless steel, for example.

The defining member 8 is made of photosensitive glass, although not limited to this material. The defining member 8 defines the pressure chambers 4 so that each pressure chamber 4 communicates with both the ink supply path 13 and the discharge channel 3. The pressure chambers 4 are elongate extending in the main scanning direction X and placed with a predetermined spacing from each other in the sub-scanning direction Y The actuator 10 is placed on the top surface of the defining member 8 (on the side opposite to that on which the nozzle plate 6 is placed) covering the pressure chambers 4. The actuator 10 is a piezoelectric actuator using the piezoelectric effect of a piezoelectric element, and in particular, a flexural vibration type piezoelectric actuator. Using this type of actuator 10, the volume of the pressure chamber 4 can be enlarged and reduced with flexural deformation of the actuator 10. With the enlargement and reduction of the volume, the pressure in the pressure chamber 4 changes, and with the change of the pressure, an ink droplet is discharged from the nozzle 2, and the pressure chamber 4 is filled with ink from the common ink chamber 5.

The actuator 10 includes a vibration plate covering each pressure chamber 4, a thin-film piezoelectric element for vibrating the vibration plate and an individual electrode placed one upon another in this order, although illustration is omitted. The vibration plate, which is formed of a chromium plate having a thickness of 2 $\mu$m, also serves as a common electrode for applying a voltage to the piezoelectric elements in association with the individual electrodes. The piezoelectric elements are placed to correspond to the respective pressure chambers 4, and can be suitably formed of lead zirconate titanate (PZT) and the like having a thickness of 0.5 $\mu$m to 5 $\mu$m. In this embodiment, the thickness of the piezoelectric elements is set at 3 $\mu$m. The individual electrodes are formed of a platinum plate having a thickness of 0.1 $\mu$m. The thickness of the entire actuator 10 is about 5 $\mu$m.

A bonding layer 11 is formed between the channel plate 7 and the pressure chamber member 12. In other words, the channel plate 7 and the pressure chamber member 12 are bonded together with an adhesive. The thickness of the entire head body 40 is set at 480 $\mu$m.

The nozzle plate 6 is formed of a polyimide plate having a thickness of 20 $\mu$m. A plurality of nozzles 2 are formed through the nozzle plate 6 to correspond to the respective pressure chambers 4. The nozzle plate 6 and the head body 40 are bonded together with an adhesive. In other words, a bonding layer 9 is formed between the nozzle plate 6 and the head body 40.

The kind of the adhesive of the bonding layer 9 is not specifically limited, but epoxy, silicone and acrylic adhesives may be suitably used. In particular, epoxy adhesives are preferred from the standpoint of improving the reliability and the adhesion strength due to their superiority in ink resistance, rigidity, thixotropy and the like.

If the bonding layer 9 is excessively thin, it may fail to absorb the surface roughness and warpage of the nozzle plate 6 and thus cause entering of outside air. If the bonding layer 9 is excessively thick, the rigidity of the entire head may be insufficient and thus cause degradation of the printing quality. In this embodiment, therefore, the adhesive is applied to a thickness of 1 $\mu$m to 20 $\mu$m and then set under pressure, to obtain the bonding layer 9 having a thickness of 1 $\mu$m to 10 $\mu$m (preferably about 5 $\mu$m).

Figure 3:
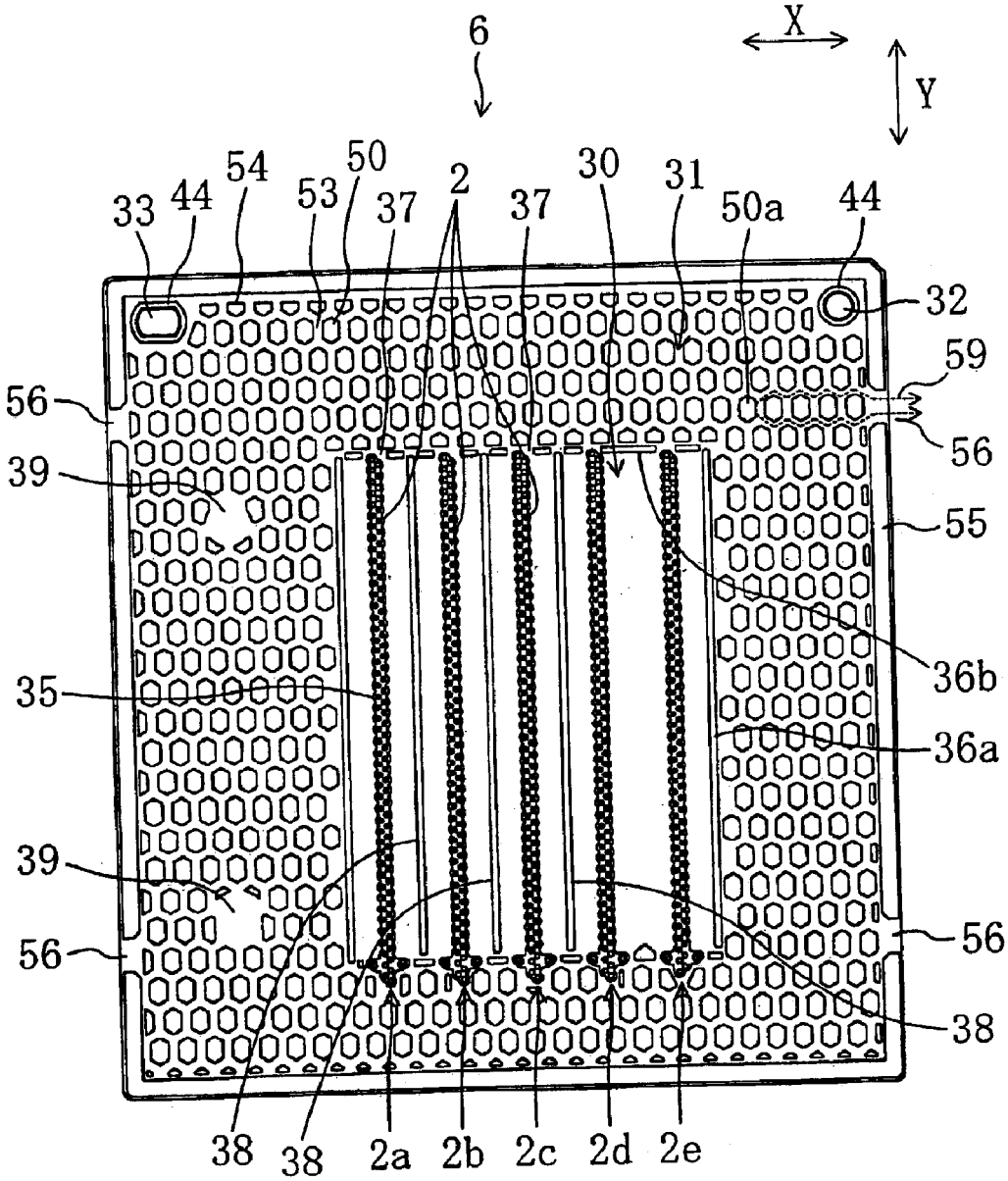
FIG. 3 is a backside view of a nozzle plate with an adhesive applied thereto in an embodiment of the present invention.

FIG. 3 shows the back surface of the nozzle plate 6, that is, the surface to which the head body 40 is bonded (bonding surface). As shown in FIG. 3, the nozzles 2 are arranged in the center portion of the nozzle plate 6, forming a nozzle region 30. A number of dot adhesives 50 are formed in the portion surrounding the nozzle region 30, forming a main bonding region 31.

In this embodiment, the nozzle region 30 includes five nozzle rows, and each nozzle row is composed of a plurality of nozzles 2 arranged in a zigzag manner. Specifically, the nozzle plate 6 of this embodiment includes nozzle rows 2*a* to 2*e* for yellow (Y), magenta (M), cyan (C), black (BK) and black (BK) from left to light as is viewed from FIG. 3. The order of the ink colors and the ink colors for the nozzle rows 2*a* to 2*e* are not limited to the above. The number of nozzle rows is not limited to the above, either.

First and second reference holes 32 and 33 are formed in the upper right and left corners, respectively, of the nozzle plate 6, as is viewed from FIG. 3. The first reference hole 32 is a through hole circular in cross section, and the second reference hole 33 is elongate in cross section in one direction (the main scanning direction X in the illustrate example).

The nozzle plate 6 is bonded to the head body 40 with the bonding layer 9 as described above. Hereinafter, the structure of the bonding layer 9, that is, the placement of adhesives applied to the nozzle plate 6 will be described with reference to FIGS. 3 to 6.

Figure 4:
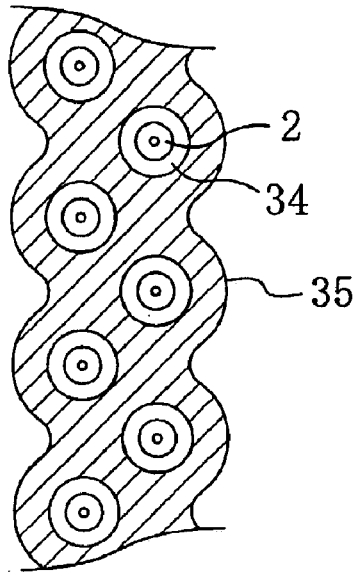
FIG. 4 is an illustration of placement of an adhesive in the vicinity of nozzles.

As shown in FIG. 4, an adhesive 35 is applied near the nozzles 2 so as to surround each nozzle 2 with a clearance 34 left from the open edge of each nozzle 2. The reason why the clearance 34 is formed between the adhesive 35 and each nozzle 2 is to keep the adhesive 35 from protruding into the nozzle 2. In FIG. 4, the region of the adhesive 35 is hatched for easy understanding. As is shown in FIGS. 3 and 4, the application of the adhesive 35 is continuous over each nozzle row. Therefore, the adhesive 35 is placed to extend in the nozzle row direction (direction Y).

Adhesives 36*a* and 36*b* are applied along the outer periphery of the nozzle region 30 in a frame shape so as to surround the nozzle region 30. The respective adhesives 36*a* extending in the nozzle row direction (direction Y) are continuous, while the respective adhesives 36*b* extending in the direction (direction X) orthogonal to the nozzle row direction are intermittent. In other words, the adhesives 36*b* have a plurality of gaps 37 for communication between the inside and outside of the nozzle region 30.

Adhesives 38 are applied to extend continuously in the nozzle row direction between the nozzle rows 2*a* and 2*b*, between the nozzle rows 2*b* and 2*c*, and between the nozzle rows 2*c* and 2*d*.

Figure 5:
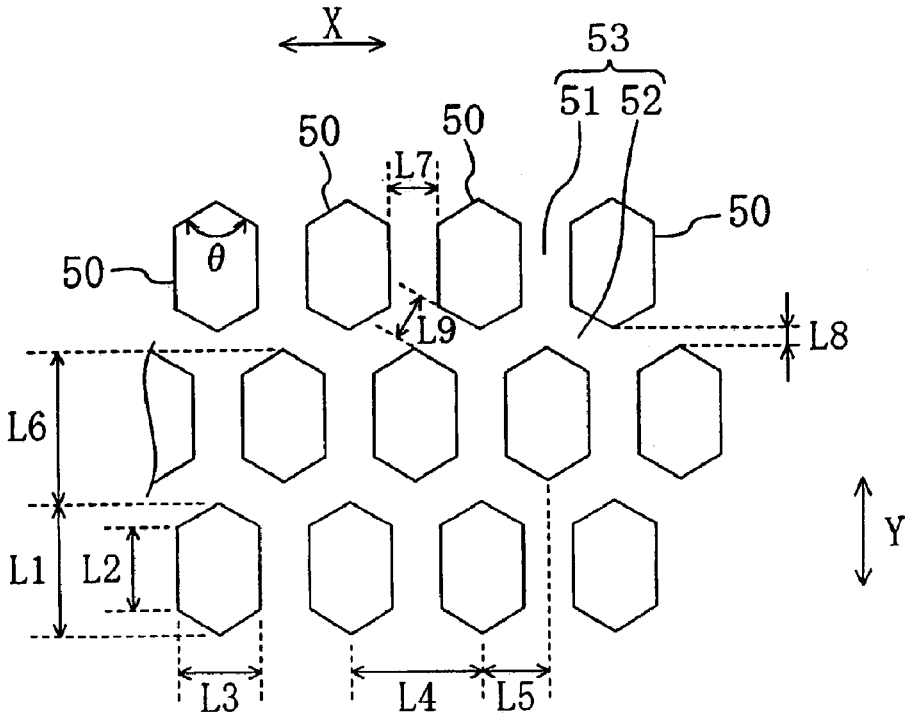
FIG. 5 is an illustration of placement of dot adhesives.

In the main bonding region 31, dot adhesives 50 are applied in a spotted manner. As shown in FIG. 5, each dot adhesive 50 is a hexagon elongate in one direction (direction Y in the illustrated example). The longitudinal length L1 of the dot adhesive 50 is 0.8 mm, and the length L2 of the major side (side in the longitudinal direction in the illustrated example) thereof is 0.5 mm. The width L3 (length orthogonal to the longitudinal direction) of the dot adhesive 50 is 0.5 mm. The angle θ of the apexes of the dot adhesive 50 facing each other in the longitudinal direction is set at 120 °.

The dot adhesives 50 are arranged at a pitch L4=0.8 mm in the direction X, forming dot rows each composed of a number of dot adhesives 50 lined in the direction X. Every two adjacent dot adhesives 50 in different dot rows adjacent in the direction Y are displaced by a half pitch L5 (that is, L4/2=0.4 mm) in the direction X. The pitch L6 of the dot adhesives 50 in the direction Y is set at 0.9 mm. As a result, a space 51 having a width L7 of 0.3 mm is formed between the dot adhesives 50 adjacent in the direction X, and a space 52 having a width L9 of 0.3 mm is formed between the dot adhesives 50 adjacent in the direction Y. Also, the distance L8 between the apexes of the adjacent dot adhesives 50 in the direction Y is 0.1 mm.

The spaces 51 and 52 are continuous over the inner and outer regions of the surface of the nozzle plate 6. Therefore, with the spaces 51 and 52, gas passages 53 extending from the inner region to the outer region are formed on the nozzle plate 6. To state differently, the bonding layer 9 defines the gas passages 53 permitting communication between the inside and the outside.

As shown in FIG. 3, dot adhesives 54 different in shape and size from the dot adhesives 50 are formed along the outer periphery of the nozzle plate 6 and in the vicinity of the nozzle region 30. Spaces are also formed between these dot adhesives 54, to define the gas passages 53.

The total area of the dot adhesives 50 and 54 is preferably 30% to 70% of the area of the bonding surface of the nozzle plate 6. If the total area of the dot adhesives 50 and 54 is excessively small, sufficient adhesion strength will not be obtained. If the total area is excessively large, the area of the gas passages 53 is small and this will make difficult smooth discharge of bubbles and by-products generated during the bonding.

Markers 39 are formed somewhere in the main bonding region 31 by omitting one or a plurality of dot adhesives 50, to serve as the reference for positioning during the bonding between the nozzle plate 6 and the head body 40.

Figure 6:
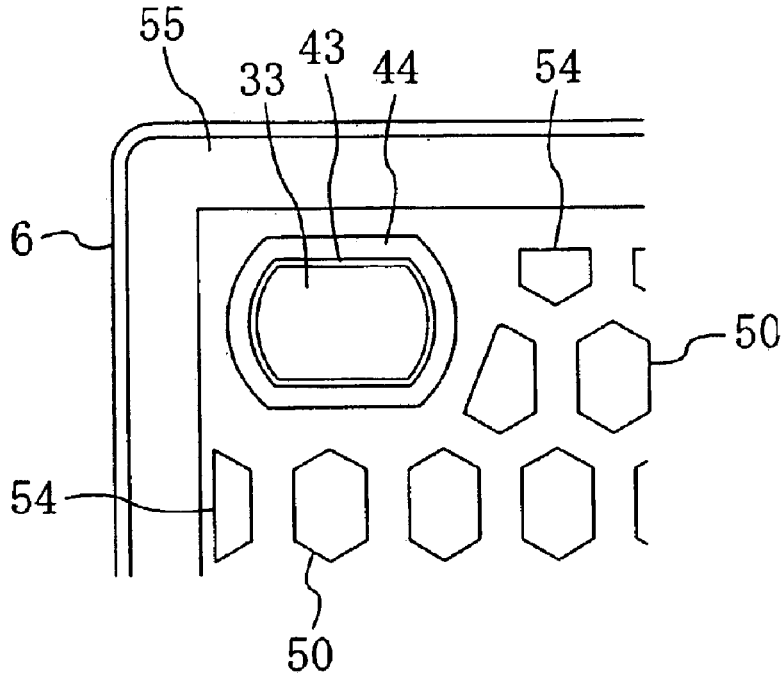
FIG. 6 is an illustration of placement of an adhesive in the vicinity of a second reference hole.

As shown in FIG. 6, an adhesive 44 is applied around the second reference hole 33 with a clearance left from the open edge of the second reference hole 33. In other words, a non-adhesive portion 43 free from an adhesive is formed between the second reference hole 33 and the adhesive 44. The reason why the non-adhesive portion 43 is formed is to keep the adhesive 44 from protruding into the second reference hole 33. The adhesive 44 has a frame shape corresponding to the shape of the second reference hole 33.

The adhesive 44 is also formed around the first reference hole 32 at a position spaced from the opening edge of the first reference hole 32 as shown in FIG. 3, with a non-adhesive portion formed between the first reference hole 32 and the adhesive 44.

An adhesive 55 is formed on the outer periphery of the nozzle plate 6, that is, around the main bonding region 31. The adhesive 55 is placed in a frame shape surrounding the entire main bonding region 31, with gas escape holes 56 formed at two positions each on the right and left sides for communication between the inner region on the nozzle plate 6 and the outside. The gas escape holes 56 are sealed after the bonding between the nozzle plate 6 and the head body 40 is finished, as will be described later. For easy sealing, the number of gas escape holes 56 is preferably 1 to 10.

In place of the frame-shaped adhesive 55, a resin frame member having cut portions serving as the gas escape holes 56 may be integrally formed with either the nozzle plate 6 or the head body 40.

Next, the bonding between the nozzle plate 6 and the head body 40 will be described. First, an adhesive is applied to the bonding surface of the nozzle plate 6 in the pattern described above. In the following description, application of a resin adhesive to the nozzle plate 6 by screen printing will be demonstrated.

Figure 7:
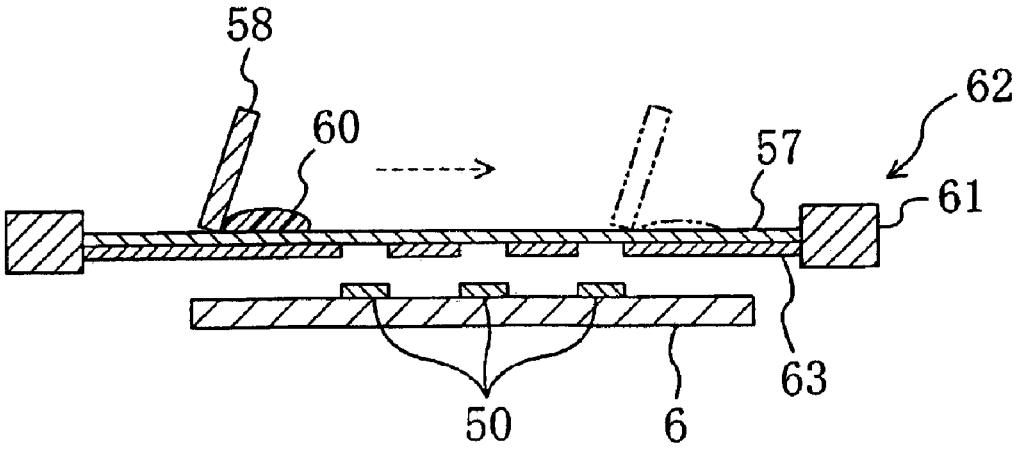
FIG. 7 is a conceptual view demonstrating a way of application of an adhesive to the nozzle plate.

Referring to FIG. 7, a mesh 57 having a shape corresponding to the adhesive placement pattern is positioned to face the bonding surface of the nozzle plate 6. An adhesive 60 is put on the mesh 57, and then pressed against the nozzle plate 6 via the mesh 57 with a squeegee 58. The squeegee 58 is preferably pushed forward in the direction of the length of the dot adhesives 50. In other words, the operation of the squeegee 58 is preferably adjusted so that the movement direction of the squeegee 58 is the same as the direction of the length of the dot adhesives 50.

By operating the squeegee 58 in the manner described above, the adhesive 60 is pressed into the gaps of the mesh 57, so that the adhesive is placed on the nozzle plate 6 in the predetermined pattern.

The reference numeral 61 denotes a screen frame made of a metal such as aluminum, for fixing the mesh 57 in the stretched state. The reference numeral 63 denotes an emulsion. The mesh 57, the screen frame 61 and the emulsion 63 constitute a screen plate 62.

Once the adhesive is applied to the nozzle plate 6 in the manner described above, the nozzle plate 6 and the head body 40 are positioned with respect to each other, and bonded together by being pressed against each other.

During the bonding, bubbles may be mixed in the adhesive due to unevenness of the surface of the resin adhesive and the like. Also, when a type of adhesive prepared by mixing two kinds of liquids is used, in particular, water may be generated or part of a solvent may be volatilized in the process of dry setting, causing generation of water, a solvent and the like as by-products. In this embodiment, however, with the provision of the gas passages 53 in the bonding layer 9 on the nozzle plate 6, a gas component 59 generated from a dot adhesive 50*a*, for example, such as a bubble and a by-product, is discharged outside through the gas passages 53 and the gas escape hole 56, as shown by the dotted-line arrows in FIG. 3.

After sufficient discharge of the gas components 59 existing inside the bonding layer 9, that is, after termination of the dry process or after the lapse of a predetermined time from termination of the dry process, the gas escape holes 56 are sealed with a sealing member made of a resin material or the like.

As described above, in this embodiment, the gas passages 53 are provided in the bonding layer 9 formed between the nozzle plate 6 and the head body 40. Therefore, bubbles and by-products that may be generated in the process of the bonding can be discharged outside through the gas passages 53. This can eliminate the possibility of peeling-off of the adhesive due to existence of a bubble or a by-product, and thus sufficient adhesion strength can be secured.

Figure 8:
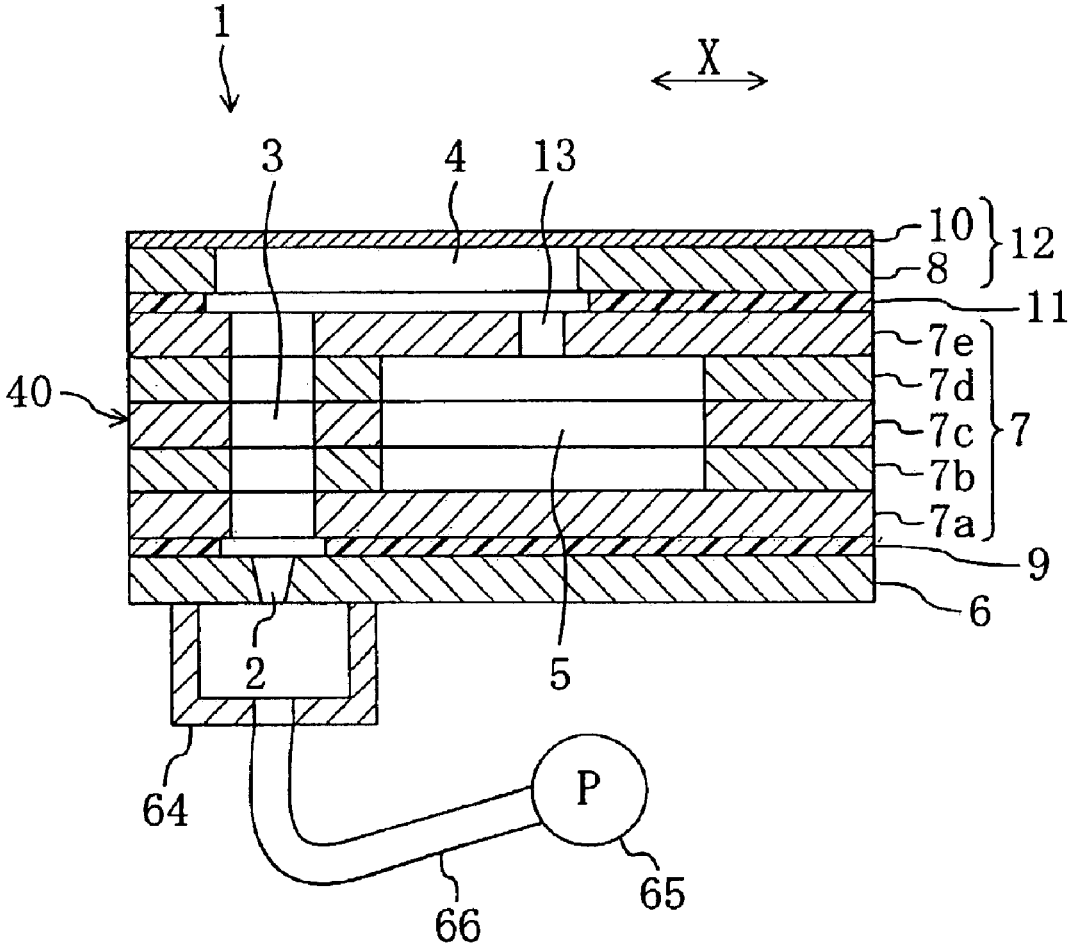
FIG. 8 is a view demonstrating purge operation of the ink-jet head.

In particular, as shown in FIG. 8, the ink-jet head 1 is periodically subjected to purge operation. During the purge operation, the nozzle 2 of the nozzle plate 6 is covered with a purge cap 64, and ink remaining inside the nozzle 2 is pumped with a purge pump 65, which is connected to the purge cap 64 via a tube 66 made of an elastic member. During the pumping, a negative pressure (purge pressure) of about −80 kPa is applied to the inside of the purge cap 64. This means that the nozzle plate 6 is subjected to a force in the direction that may peel the nozzle plate 6 off from the head body 40. In this situation, if the adhesion strength between the nozzle plate 6 and the head body 40 is insufficient, part of the nozzle plate 6 may be peeled off from the head body 40 during the purge operation, resulting in loss of the reliability of the ink-jet head 1.

In this embodiment, however, since firm bonding is established between the nozzle plate 6 and the head body 40, the nozzle plate 6 is prevented from peeling off even if a large purge pressure is applied.

Since the gas passages 53 are defined by the dot adhesives 50 that are dotted uniformly over the main bonding region 31, uniform placement of the gas passages 53 on the nozzle plate 6 is possible.

Since the non-adhesive portions 43 are formed between the reference holes 32 and 33 and the adhesives 44, the adhesives 44 are prevented from protruding into the reference holes 32 and 33.

Since screen printing is adopted for application of the adhesive, the adhesive on the nozzle plate 6, such as the dot adhesives 50 and 54 and the adhesives 44 around the 5 reference holes 32 and 33, can be placed in a predetermined pattern with high precision.

In formation of the dot adhesives 50 by screen printing, the squeegee 58 is moved in the direction of the length of the dot adhesives 50. By this movement, the transferability of the dot adhesives 50 can be improved. To state more specifically, the width of each dot adhesive 50 is gradually larger toward the center of the shape of the dot adhesive from one apex, is constant in the center portion, and then is gradually smaller toward the other apex. With this width of the dot adhesives 50 continuously changing in the direction of the movement of the squeegee 58, the adhesive can be transferred nicely compared with a shape having a width changing discontinuously.

The gas escape holes 56 are sealed after the bonding between the nozzle plate 6 and the head body 40. This prevents foreign matters such as dust and dirt from entering the bonding layer 9 from outside.

In the embodiment described above, the adhesive was applied to the nozzle plate 6.

Alternatively, the adhesive may be applied to the head body 40, or to both the nozzle plate 6 and the head body 40.

As the resin adhesive, a thermosetting resin or a thermoplastic resin may be used.

Alterations

Figure 9A:
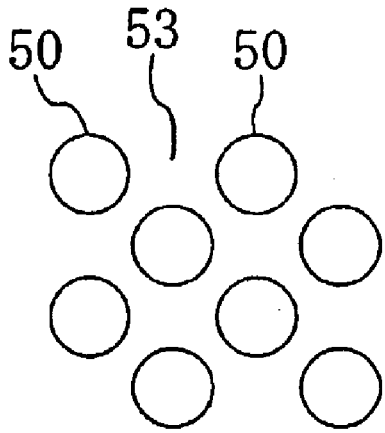
FIGS. 9A to 9D are illustrations of alterations of the dot adhesives.
Figure 9C:
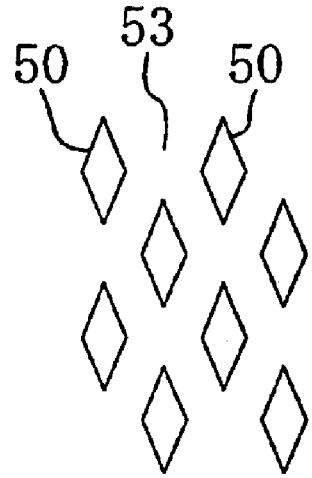
Figure 9B:
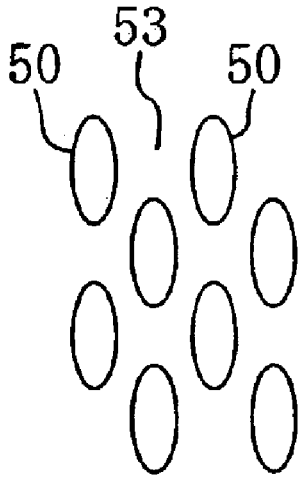
Figure 9D:
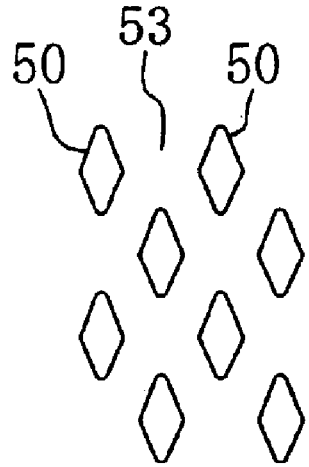

The shape of the dot adhesives 50 is not limited to the hexagon as it was in the embodiment described above. For example, the dot adhesives 50 may be in the shape of a perfect circle as shown in FIG. 9A, in the shape of an oval as shown in FIG. 9B, or in the shape of a rhombus as shown in DIG. 9C. Otherwise, the dot adhesives 50 may be in the shape of a polygon of which one apex or two or more apexes are rounded. For example, as shown in FIG. 9D, the dot adhesives 50 may be in the shape of a rhombus of which the two apexes are rounded. In application of the dot adhesives 50 having the shapes described above by screen printing, the squeegee is preferably moved in the direction of the length of the dot adhesives 50, as in the embodiment described above.

In the embodiment described above, the dot adhesives 50 were placed in uniform on the nozzle plate 6. Naturally, the placement of the dot adhesives 50 may be nonuniform. It should be noted however that, to prevent gas components from remaining inside the bonding layer and ensure smooth discharge of the gas components, the dot adhesives should preferably be placed so as to be sparser as the position is closer to the outside. In other words, the density of the dot adhesives 50 is preferably lower in the outer region than in the inner region, to secure a larger area of the gas passages 53 as the position is closer to the outside.

Figure 10:
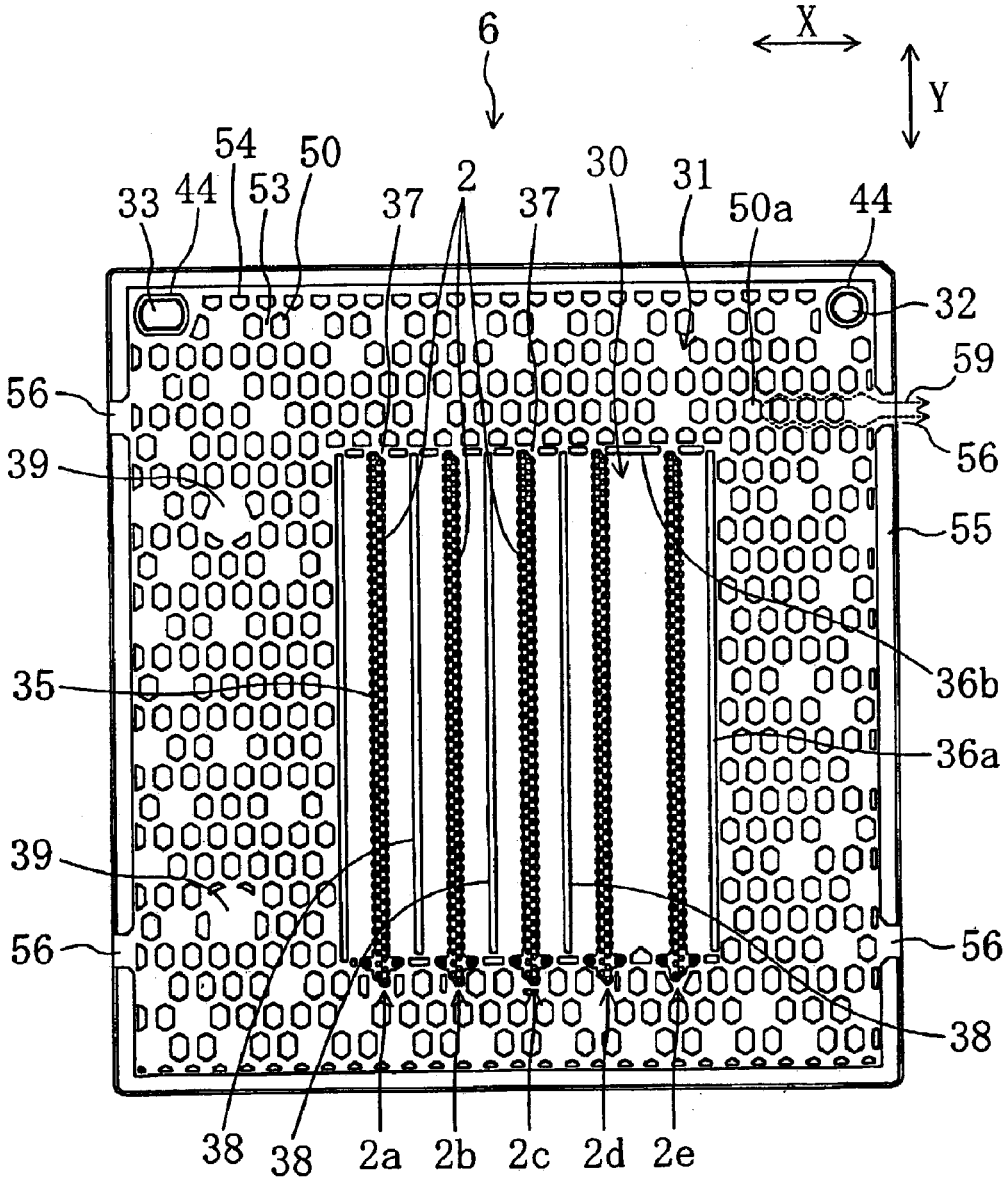
FIG. 10 is a backside view of a nozzle plate with an adhesive applied thereto in an alteration to the embodiment of the present invention.

As shown in FIG. 10, the placement pattern of the dot adhesives 50 may be changed so that the dot adhesives 50 are gradually sparser as the position on the nozzle plate 6 is closer to the outside. This enables smooth and swift discharge of gas components such as bubbles and by-products generated during the bonding.

The pattern that the area of the gas passages 53 is larger as the position is closer to the outside can be attained, not only by changing the number of dot adhesives 50, but also by decreasing the size of the dot adhesives 50 as the position is closer to the outside, or by increasing the gap between the adjacent dot adhesives 50 as the position is closer to the outside. In this way, the shape and size of the gas passages 53 can be freely set by adjusting the shape and size of the dot adhesives 50 or the gap between the adjacent dot adhesives 50.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention which fall within the true spirit and scope of the invention.

What is claimed is:

1. An ink-jet head comprising:

a nozzle plate having a plurality of nozzles;

a head body including a plurality of pressure chambers for storing ink, the pressure chambers communicating with the respective nozzles, and a plurality of pressure generators for applying pressure to the ink in the pressure chambers to allow the ink to be discharged from the nozzles; and a bonding layer made of an adhesive formed between the nozzle plate and the head body for bonding the nozzle plate and the head body together, wherein a passage extending from an inner region on the nozzle plate to an outer region on the nozzle plate is formed in the bonding layer, the bonding layer includes a plurality of dot adhesives placed separately from one another on the nozzle plate or the head body, the passage in the bonding layer is formed from gaps between the dot adhesives, and the dot adhesives are placed on the nozzle plate or the head body so as to be sparser as the position is closer to the outer region of the nozzle plate.

2. An ink-jet head comprising:

a nozzle plate having a plurality of nozzles;

a head body including a plurality of pressure chambers for storing ink, the pressure chambers communicating with the respective nozzles, and a plurality of pressure generators for applying pressure to the ink in the pressure chambers to allow the ink to be discharged from the nozzles; and a bonding layer made of an adhesive formed between the nozzle plate and the head body for bonding the nozzle plate and the head body together, wherein a passage extending from an inner region on the nozzle plate to an outer region on the nozzle plate is formed in the bonding layer, the bonding layer includes a plurality of dot adhesives placed separately from one another on the nozzle plate or the head body, the passage in the bonding layer is formed from gaps between the dot adhesives, and the dot adhesives are placed on the nozzle plate or the head body so as to be sparser as the position is closer to the outer region of the nozzle plate, the bonding layer includes a frame adhesive placed in a shape of a frame along the outer periphery of the nozzle plate, and the frame adhesive has a hole formed for permitting communication between the inner region on the nozzle plate and the outside, and the hole is sealed after termination of bonding between the nozzle plate and the head body.

3. The ink-jet head of claim 2, wherein the number of the holes is in a range of 1 to 10.

4. An ink-jet head comprising:

a nozzle plate having a plurality of nozzles;

a head body including a plurality of pressure chambers for storing ink, the pressure chambers communicating with the respective nozzles, and a plurality of pressure generators for applying pressure to the ink in the pressure chambers to allow the ink to be discharged from the nozzles; and a bonding layer made of an adhesive formed between the nozzle plate and the head body for bonding the nozzle plate and the head body together, wherein a passage extending from an inner region on the nozzle plate to an outer region on the nozzle plate is formed in the bonding layer, a reference hole for positioning with the head body is formed on the nozzle plate and, the bonding layer includes an adhesive formed around the reference hole at a position spaced from an opening edge of the reference hole, forming a non-adhesive portion between the adhesive and the reference hole.

5. A method for producing an ink-jet head including a nozzle plate and a head body bonded together with an adhesive, the method comprising the steps of:

forming a frame member along an outer periphery of a surface of at least one of the nozzle plate and the head body, the frame member having a cut portion;

applying an adhesive to only a predetermined portion of a gap between the nozzle plate and the head body;

bonding the nozzle plate and the head body together with the adhesive with the frame member interposed therebetween; and sealing the cut portion after a lapse of a predetermined time from termination of the step of bonding.

6. An ink-jet head comprising:

a nozzle plate having a plurality of nozzles;

a head body including a plurality of pressure chambers for storing ink, the pressure chambers communicating with the respective nozzles, and a plurality of pressure generators for applying pressure to the ink in the pressure chambers to allow the ink to be discharged from the nozzles; and a bonding layer made of an adhesive formed between the nozzle plate and the head body for bonding the nozzle plate and the head body together, wherein a passage extending from an inner region on the nozzle plate to an outer region on the nozzle plate is formed in the outer periphery of the bonding layer.

7. An ink-jet head comprising:

a nozzle plate having a plurality of nozzles;

a head body including a plurality of pressure chambers for storing ink, the pressure chambers communicating with the respective nozzles, and a plurality of pressure generators for applying pressure to the ink in the pressure chambers to allow the ink to be discharged from the nozzles; and a bonding layer made of an adhesive formed between the nozzle plate and the head body for bonding the nozzle plate and the head body together, wherein a passage that is formed in the bonding layer extends from an inner region on the nozzle plate to an outer region on the nozzle plate and is formed from the vicinity of a nozzle region on the nozzle plate to the outer periphery of the nozzle plate.

8. An ink-jet head comprising:

a nozzle plate having a plurality of nozzles;

a head body including a plurality of pressure chambers for storing ink, the pressure chambers communicating with the respective nozzles, and a plurality of pressure generators for applying pressure to the ink in the pressure chambers to allow the ink to be discharged from the nozzles; and a bonding layer made of an adhesive formed between the nozzle plate and the head body for bonding the nozzle plate and the head body together, wherein the bonding layer includes a frame adhesive placed in a shape of a frame along the outer periphery of the nozzle plate, and the frame adhesive has a hole formed therein, permitting communication between an inner region on the nozzle plate and an outer region of the nozzle plate.

* * * * *